US007292797B2

(12) United States Patent
Kunugi et al.

(10) Patent No.: US 7,292,797 B2
(45) Date of Patent: Nov. 6, 2007

(54) TONER QUANTITY MEASURING DEVICE, METHOD OF MEASURING TONER QUANTITY AND IMAGE FORMING APPARATUS

(75) Inventors: Masanao Kunugi, Suwa (JP); Mitsutaka Nishikawa, Suwa (JP)

(73) Assignee: Seiko Epson Corporation (JP)

( * ) Notice: Subject to any disclaimer, the term of this patent is extended or adjusted under 35 U.S.C. 154(b) by 281 days.

(21) Appl. No.: 11/070,409

(22) Filed: Mar. 1, 2005

(65) Prior Publication Data

US 2005/0196188 A1 Sep. 8, 2005

(30) Foreign Application Priority Data

Mar. 2, 2004 (JP) ..... 2004-058225
Mar. 2, 2004 (JP) ..... 2004-058226

(51) Int. Cl.
*G03G 15/00* (2006.01)

(52) U.S. Cl. ..... 399/49; 399/61; 399/64

(58) Field of Classification Search ..... 399/38, 399/49, 74, 252, 260, 58, 61, 64
See application file for complete search history.

(56) References Cited

U.S. PATENT DOCUMENTS

| | | | | |
|---|---|---|---|---|
| 5,869,214 | A * | 2/1999 | Anzai et al. | 430/47 |
| 6,185,007 | B1 * | 2/2001 | Hayashi et al. | 358/1.9 |
| 6,434,346 | B1 | 8/2002 | Knott et al. | |
| 7,033,837 | B1 | 4/2006 | Maier et al. | |

FOREIGN PATENT DOCUMENTS

| | | |
|---|---|---|
| JP | 61-095370 | 5/1986 |
| JP | 61-203479 | 9/1986 |
| JP | 02-264984 | 10/1990 |
| JP | 03-215876 | 9/1991 |
| JP | 04-149573 | 5/1992 |
| JP | 04-267274 | 9/1992 |
| JP | 05-224498 | 9/1993 |
| JP | 06-138765 | 5/1994 |
| JP | 06-186898 | 7/1994 |

(Continued)

OTHER PUBLICATIONS

Communications from Japanese Patent Office re: related applications.

*Primary Examiner*—Hoan Tran
(74) *Attorney, Agent, or Firm*—Harness, Dickey & Pierce, P.L.C.

(57) ABSTRACT

A toner quantity measuring device, a method of measuring toner quantity and an image forming apparatus are provided that can accurately measure the toner quantity in an environmentally friendly manner, without having to make contact with a toner carrier and within a shortened period of time. The toner quantity measuring device is designed to measure the quantity of the toner T on a developing roller 510 which carries coloring agent-containing toner T in the form of a thin layer. The toner quantity measuring device is provided with a chromaticity detector 3 for detecting average chromaticity of the light which is irradiated from a light source 2 onto the developing roller 510 and then reflected by the developing roller 510, and a calculator 4 for calculating the toner quantity based on the average chromaticity detected by the chromaticity detector 3.

24 Claims, 4 Drawing Sheets

FOREIGN PATENT DOCUMENTS

| | | |
|---|---|---|
| JP | 08-017920 | 1/1996 |
| JP | 08-179620 | 7/1996 |
| JP | 08-507148 | 7/1996 |
| JP | 08-233653 | 9/1996 |
| JP | 08-334950 | 12/1996 |
| JP | 09-015952 | 1/1997 |
| JP | 09-319224 | 12/1997 |
| JP | 10-222003 | 8/1998 |
| JP | 10-340015 | 12/1998 |
| JP | 11-038666 | 2/1999 |
| JP | 11-143213 | 5/1999 |
| JP | 11-231601 | 8/1999 |
| JP | 2000-081736 | 3/2000 |
| JP | 2000-162836 | 6/2000 |
| JP | 2001-034109 | 2/2001 |
| JP | 2001-264294 | 9/2001 |
| JP | 2002-031961 | 1/2002 |
| JP | 2002-500359 | 1/2002 |
| JP | 2002-501179 | 1/2002 |
| JP | 2002-091085 | 3/2002 |
| JP | 2002-509291 | 3/2002 |
| JP | 2002-154826 | 5/2002 |
| JP | 2002-268318 | 9/2002 |
| JP | 2002-296951 | 10/2002 |
| JP | 2002-328501 | 11/2002 |
| JP | 2003-029571 | 1/2003 |
| JP | 2003-122129 | 4/2003 |
| JP | 2003-189710 | 7/2003 |
| JP | 2003-238163 | 8/2003 |
| JP | 2004-053863 | 2/2004 |
| JP | 2004-069948 | 3/2004 |
| JP | 2004-126233 | 4/2004 |
| JP | 2004-126234 | 4/2004 |
| JP | 2004-170934 | 6/2004 |
| JP | 2004-198570 | 7/2004 |
| JP | 2005-084407 | 3/2005 |
| JP | 2005-170689 | 6/2005 |
| JP | 2005-208072 | 8/2005 |
| JP | 2005-266470 | 9/2005 |
| JP | 2005-315990 | 11/2005 |
| WO | WO 94/19690 | 9/1994 |
| WO | WO 99/35602 | 7/1999 |

* cited by examiner

TONER QUANTITY MEASURING DEVICE, METHOD OF MEASURING TONER QUANTITY AND IMAGE FORMING APPARATUS

BACKGROUND OF THE INVENTION

1. Field of the Invention

The present invention relates to a toner quantity measuring device, a method of measuring toner quantity and an image forming apparatus.

2. Description of the Prior Art

Image forming apparatuses such as copiers and printers, which employ electrophotography, are designed to form toner images on a recording medium like a paper through a series of image forming processes including an electrifying step, an exposure step, a developing step, a transfer step and a fixing step.

At the developing step, as an example, under the state that a developing roller, which carries toner, is caused to make contact with or closely positioned to a photosensitive member carrying an electrostatic latent image, the electrified toner on the developing roller is applied to the latent image, thereby visualizing the latent image as a toner image. At this moment, if the quantity of the toner on the developing roller is not kept uniform within a permissible extent in a longitudinal direction of the developing roller, there may arise such an instance that the quantity of the toner applied is subject to unwanted variation or surplus-and-shortage, which in turn makes it impossible to perform the developing process in a desired manner. In order to avoid this situation, at the final stage in a production line, the quantity of the toner on the developing roller is measured to determine whether the toner quantity measured remains within a predetermined range or not.

Conventionally, there is generally known a toner quantity measuring method wherein the toner quantity is measured by way of causing the toner in a predetermined area of the developing roller to adhere to an adhesive tape having known weight, and then measuring the increased weight of the adhesive tape on which the toner is stuck.

However, such a method involves a drawback in that the task of sticking and peeling off the adhesive tape with respect to the developing roller has to be carried out manually and thus a prolonged period of time is required to measure the toner quantity, which results in an increased manufacturing cost of the products.

In addition, this method lacks consideration for environment because the adhesive tape is doomed to be wastes at the end of the measuring process.

Moreover, due to the fact that the adhesive tape is brought into contact with the developing roller at the time of measurement, the developing roller may suffer from scratches and the adhesive agent of the tape may be left on the developing roller. This will give rise to a possibility of reducing the image quality of the image forming apparatus.

Still further, in the event that the toner on the developing roller has an increased quantity and greater thickness, it becomes difficult to have the toner in the target area adhere to the adhesive tape in its entirety, and thereby a difficulty may be encountered in obtaining accurate outcome of measurement.

In addition to the method referred to above, there is known a method using a non-woven fabric having known weight, as another example of the toner quantity measuring method wherein the toner quantity is measured by adhesion of the toner (see, for example, paragraph 37 of Japanese Laid-open Patent Publication No. 8-17920). This method also has the same problems as in the prior art method set forth above.

SUMMARY OF THE INVENTION

It is therefore an object of the present invention to provide a toner quantity measuring device, a method of measuring toner quantity and an image forming apparatus that can accurately measure the toner quantity in an environmentally friendly manner, without having to make contact with a toner carrier and within a shortened period of time.

In order to achieve the object noted just above, the present invention provides a toner quantity measuring device for use in measuring the quantity of toner on a toner carrier which carries the toner in the form of a thin layer, comprising: light irradiating means for irradiating light onto the toner carrier; reflected light detecting means for detecting the light reflected from the toner carrier; and calculating means for calculating the toner quantity based on the reflected light detected by the reflected light detecting means.

With this arrangement, the light irradiated onto the toner carrier by the light irradiating means becomes a reflected light corresponding to the toner quantity on the toner carrier. The reflected light is detected by the reflected light detecting means and the toner quantity is calculated by the calculating means based on the reflected light. As a result, the toner quantity can be accurately measured without having to make contact with a toner carrier in a shortened period of time. Further, no waste is generated in the course of measurement, thus making it possible to perform the measuring process in an environmentally friendly manner.

Preferably, the toner quantity measuring device according to the present invention is designed to measure the quantity of toner on a toner carrier which carries coloring agent-containing toner in the form of a thin layer, and comprises chromaticity detecting means for detecting average chromaticity of the light irradiated onto the toner carrier by a light source and reflected from the toner carrier, the calculating means adapted to calculate the toner quantity based on the average chromaticity detected by the chromaticity detecting means.

By way of this construction, as the light is irradiated onto the toner carrier from the light source, the wavelength component of the light whose chromaticity corresponds to the toner quantity on the toner carrier is detected by the chromaticity detecting means. This makes it possible for the calculating means to calculate the toner quantity based on the average chromaticity detected by the chromaticity detecting means.

In the toner quantity measuring device of the present invention, it is preferred that the calculating means performs the toner quantity calculation based on the difference between the average chromaticity detected by the chromaticity detecting means and a predetermined chromaticity. By virtue of this, the toner quantity can be calculated based on the difference between the average chromaticity detected by the chromaticity detecting means and the predetermined chromaticity.

In the toner quantity measuring device of the present invention, it is also preferred that the chromaticity detecting means comprises a charge coupled device for receiving the light reflected from the toner carrier and is adapted to detect the chromaticity by operationally treating output signals of the charge coupled device.

This assures that the average chromaticity of the light reflected from the toner carrier can be detected in more accurate manner, thus making it possible to measure the toner quantity precisely. In addition, it becomes possible to accurately detect the average chromaticity of the light reflected from the toner carrier, even when the amount of the light irradiated from the light source is relatively small. Accordingly, a small-sized and less costly light source can be employed.

In the toner quantity measuring device of the present invention, it is also preferred that the chromaticity detecting means is adapted to detect the chromaticity as tristimulus values. This allows the calculating means to calculate the toner quantity in a relatively simple method through the use of average color difference.

In the toner quantity measuring device of the present invention, it is also preferred that the light source comprises a white color light source. This assures that the average chromaticity of the light reflected from the toner carrier can be detected in more accurate manner, thus making it possible to measure the toner quantity precisely.

In the toner quantity measuring device of the present invention, it is also preferred that the toner carrier is rotatably provided and the chromaticity detecting means is adapted to detect the average chromaticity while scanning a range of measurement in a direction along which a rotational axis of the toner carrier lies. This makes it possible to know, with the use of relatively simple arrangement, the toner quantity distribution in the direction of the rotational axis of-the toner carrier.

In the toner quantity measuring device of the present invention, it is also preferred that the toner carrier comprises a developing roller. This makes it possible to accurately measure the toner quantity on the developing roller in an environmentally friendly manner, without having to make contact with the developing roller and within a shortened period of time.

In the toner quantity measuring device of the present invention, it is also preferred that the toner carrier comprises a photosensitive member. This makes it possible to accurately measure the toner quantity on the photosensitive member in an environmentally friendly manner, without having to make contact with the photosensitive member and within a shortened period of time.

In the toner quantity measuring device of the present invention, it is also preferred that the toner carrier comprises a transfer member. This makes it possible to accurately measure the toner quantity on the transfer member in an environmentally friendly manner, without having to make contact with the transfer member and within a shortened period of time.

Preferably, the toner quantity measuring device in accordance with the present invention for measuring the quantity of toner on a toner carrier which carries the toner in the form of a thin layer comprises infrared ray irradiating means for irradiating infrared rays onto the toner carrier, intensity detecting means for detecting the intensity of the infrared rays reflected from the toner carrier, and calculating means for calculating the toner quantity based on the intensity detected by the intensity detecting means.

By virtue of this, a part of the infrared rays irradiated onto the toner carrier from the infrared ray irradiating means is absorbed to the toner on the toner carrier in an amount corresponding to the quantity of the toner. At the same time, the remaining part of the infrared rays is reflected from the toner carrier and then detected by the intensity detecting means. This allows the calculating means to calculate the toner quantity based on the intensity detected by the intensity detecting means.

In the toner quantity measuring device of the present invention, it is preferred that the calculating means is adapted to calculate the toner quantity based on the difference between the intensity detected by the intensity detecting means and the predetermined intensity.

This makes it possible that the toner quantity can be detected by the calculating means in correspondence to the difference between the intensity detected by the intensity detecting means and the predetermined intensity.

In the toner quantity measuring device of the present invention, it is also preferred that the toner comprises resin as a component thereof.

With this construction, the quantity of the toner on the toner carrier can be calculated by way of detecting the amount of the resin contained in the toner. This assures trustworthy and accurate measurement of the toner quantity.

In the toner quantity measuring device of the present invention, it is also preferred that the intensity detecting means can detect the intensity of the infrared rays whose wavelength corresponds to absorption spectrum of C—H bonds of the resin contained in the toner.

With such an arrangement, the quantity of the toner on the toner carrier can be calculated by way of detecting the amount of C—H bonds, a characterizing structure of the resin contained in the toner. This assures trustworthy and accurate measurement of the toner quantity.

In the toner quantity measuring device of the present invention, it is also preferred that light collecting means is provided for collecting the infrared rays reflected from the toner carrier and the intensity detecting means is adapted to detect the infrared rays collected by the light collecting means.

By virtue of this, it becomes possible to prevent any reduction in the accuracy of detection of the intensity detecting means, even if the infrared rays is scattered in the course of reflection from the toner carrier.

In the toner quantity measuring device of the present invention, it is also preferred that the infrared ray irradiating means is adapted to irradiate, on the toner carrier, the infrared rays whose wavelength corresponds to absorption spectrum of C—H bonds of the resin contained in the toner.

According to this arrangement, the quantity of the toner on the toner carrier can be calculated by way of detecting the amount of C—H bonds, a characterizing structure of the resin contained in the toner. This assures trustworthy and accurate measurement of the toner quantity.

In the toner quantity measuring device of the present invention, it is also preferred that the toner carrier is composed of inorganic material at its surface region.

This ensures that the infrared rays irradiated onto the toner carrier is not absorbed to the toner carrier but to the toner on the toner carrier in an amount corresponding to the quantity of the toner, thus enabling the calculating means to calculate the quantity of the toner on the toner carrier in a relatively simple manner.

In the toner quantity measuring device of the present invention, it is also preferred that the toner carrier is rotatably provided and the intensity detecting means is adapted to detect the intensity while scanning a range of detection in a direction along which a rotational axis of the toner carrier lies.

By virtue of this, it becomes possible to know, with the use of relatively simple arrangement, the toner quantity distribution in the direction of the rotational axis of the toner carrier.

In accordance with another aspect of the present invention, there is provided a method of measuring toner quantity for measuring the quantity of toner on a toner carrier which carries the toner in the form of a thin layer, comprising the steps of: causing light irradiating means to irradiate light onto the toner carrier; detecting the light reflected from the toner carrier through the use of reflected light detecting means; and calculating the toner quantity based on the reflected light detected by the reflected light detecting means. This assures that the toner quantity can be accurately measured in an environmentally friendly manner, without having to make contact with a toner carrier and within a shortened period of time.

In this instance, preferably, the toner contains coloring agent, the reflected light detecting means comprises a chromaticity detecting means for detecting average chromaticity of the light irradiated onto the toner carrier by the light irradiating means and reflected from the toner carrier and the toner quantity is calculated based on the color difference between the average chromaticity detected by the chromaticity detecting means and a predetermined chromaticity.

By way of this construction, as the light is irradiated onto the toner carrier from the light source, the wavelength component of the light whose chromaticity corresponds to the toner quantity on the toner carrier is detected by the chromaticity detecting means. This makes it possible for the calculating means to calculate the toner quantity on the basis of the average chromaticity detected by the chromaticity detecting means.

Moreover, in the method of measuring toner quantity according to the present invention, it is preferred that the light irradiating means comprises infrared ray irradiating means for irradiating infrared rays onto the toner carrier, the reflected light detecting means comprises intensity detecting means for detecting the intensity of the infrared rays reflected from the toner carrier, and the toner quantity is calculated based on the intensity detected by the intensity detecting means.

By virtue of this, a part of the infrared rays irradiated onto the toner carrier from the infrared ray irradiating means is absorbed to the toner on the toner carrier in an amount corresponding to the quantity of the toner. At the same time, the remaining part of the infrared rays is reflected from the toner carrier and then detected by the intensity detecting means. This allows the calculating means to calculate the toner quantity based on the intensity detected by the intensity detecting means.

In accordance with a further aspect of the present invention, there is provided an image forming apparatus for use in recording images formed through a series of image forming processes on a recording medium, comprising: a toner quantity measuring device for measuring the quantity of toner on a toner carrier which carries the toner in the form of a thin layer, wherein the toner quantity measuring device comprises light irradiating means for irradiating light onto the toner carrier, reflected light detecting means for detecting the light reflected from the toner carrier, and calculating means for calculating the toner quantity based on the reflected light detected by the reflected light detecting means. This image forming apparatus assures that the toner quantity can be accurately measured in an environmentally friendly manner, without having to make contact with a toner carrier and within a shortened period of time.

In this instance, preferably, the toner contains coloring agent, the reflected light detecting means comprises chromaticity detecting means for detecting average chromaticity of the light irradiated onto the toner carrier by the light irradiating means and reflected from the toner carrier, and the calculating means is so constructed as to calculate the toner quantity based on the average chromaticity detected by the chromaticity detecting means.

By way of this construction, as the light is irradiated onto the toner carrier from the light source, the wavelength component of the light whose chromaticity corresponds to the toner quantity on the toner carrier is detected by the chromaticity detecting means. This makes it possible for the calculating means to calculate the toner quantity based on the average chromaticity detected by the chromaticity detecting means.

Still further, preferably, the light irradiating means comprises infrared ray irradiating means for irradiating infrared rays onto the toner carrier, the reflected light detecting means comprises intensity detecting means for detecting the intensity of the infrared rays reflected from the toner carrier, and the calculating means is so constructed as to calculate the toner quantity based on the intensity detected by the intensity detecting means.

By virtue of this, a part of the infrared rays irradiated onto the toner carrier from the infrared ray irradiating means is absorbed to the toner on the toner carrier in an amount corresponding to the quantity of the toner. At the same time, the remaining part of the infrared rays is reflected from the toner carrier and then detected by the intensity detecting means. This allows the calculating means to calculate the toner quantity based on the intensity detected by the intensity detecting means.

The above and other objects and features of the invention will become more apparent from the following detailed description when the same is read in conjunction with the accompanying drawings that are presented for the purpose of illustration only.

DETAILED DESCRIPTION OF THE PREFERRED EMBODIMENTS

The present invention relates to a toner quantity measuring device for use in measuring the quantity of toner on a toner carrier that carries the toner in the form of a thin layer. The toner quantity measuring device is characterized by comprising a light irradiating means for irradiating light onto the toner carrier, a reflected light detecting means for detecting the light reflected from the toner carrier, and a calculating means for calculating the toner quantity based on the reflected light detected by the reflected light detecting means.

Certain embodiments of the present invention will be described herein below.

A first embodiment of the invention is adapted for measuring the quantity of the toner on a toner carrier, and is characterized in that the average chromaticity of the light irradiated from a light source onto the toner carrier and reflected from the toner carrier is detected by a chromaticity detecting means and the toner quantity is calculated on the basis of the average chromaticity detected by the chromaticity detecting means. Examples of the toner carrier referred to herein include, but is not particularly limited thereto, a developing roller, a photosensitive member and a transfer member that are provided in image forming apparatuses such as copiers and printers of electrophotographic type. Hereinbelow, in advance of describing a toner quantity measuring device and a method of measuring toner quantity of the present invention, construction and operation of an image forming apparatus will be first described.

[Image Forming Apparatus]

As an example of the image forming apparatus, a laser beam printer (simply referred to as "printer" herein below) 10 is first described with reference to FIG. 1.

Figure 1:
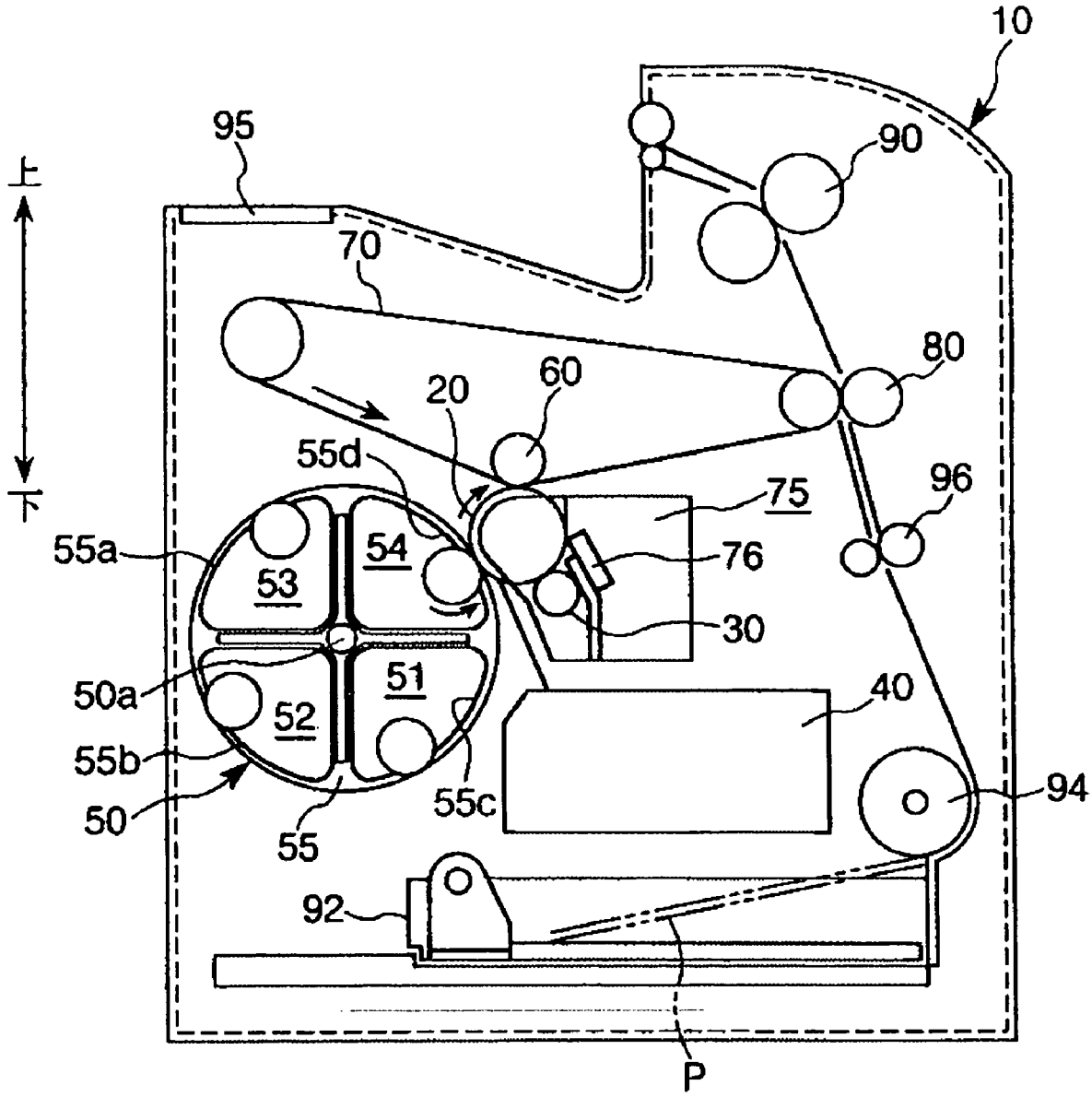
FIG. 1 is a schematic cross-sectional view showing the simplified construction of an image forming apparatus in accordance with an aspect of the present invention.

FIG. 1 is a schematic cross-sectional view showing the simplified construction of the printer 10, in which view the up-and-down direction is indicated by an arrow.

As shown in FIG. 1, the printer 10 is provided with a photosensitive member 20 that carries latent images and rotates in the direction of the arrow. Along the rotational direction of the photosensitive member 20, there are disposed an electrifying unit 30, an exposure unit 40, a developing unit 50, a primary transfer unit 60, an intermediate transfer member 70 and a cleaning unit 75 in the named sequence. In addition, the printer 10 is provided, at the lower part in FIG. 1, with a paper supply tray 92 that serves to feed a recording medium P such as a paper. A secondary transfer unit 80 and a fixing unit 90 are sequentially disposed with respect to the paper supply tray 92 at the downstream of the conveying direction of the recording medium P.

The photosensitive member 20 has an electrically conductive substrate of cylindrical configuration and a photosensitive layer formed on the circumference of the substrate. The photosensitive member 20 is rotatable about its axis in the direction indicated with an arrow in FIG. 1.

The electrifying unit 30 is an apparatus for uniformly electrifying the surface of the photosensitive member 20 by means of, e.g., corona electrification.

The exposure unit 40 is an apparatus adapted to create electrostatic latent images in such a manner that it receives image information from a host computer such as a personal computer not shown in the drawings and, in response to the image information received, irradiates a laser beam onto the uniformly electrified photosensitive member 20.

The developing unit 50 comprises four developing devices, i.e., a black developing device 51, a magenta developing device 52, a cyan developing device 53 and a yellow developing device 54. These developing devices are selectively utilized in correspondence to the latent images on the photosensitive member 20 to thereby visualize the latent images as toner images. The black developing device 51, the magenta developing device 52, the cyan developing device 53 and the yellow developing device 54 are adapted to develop the images through the use of black(K) toner, magenta(M) toner, cyan(C) toner and yellow(Y) toner, respectively.

In the present embodiment, the YMCK developing unit 50 is rotatable in such a manner that it can cause the four developing devices 51, 52, 53, 54 to selectively face the photosensitive member 20. More specifically, the four developing devices 51, 52, 53, 54 of the YMCK developing unit 50 are respectively supported on four holder portions 55*a*, 55*b*, 55*c*, 55*d* of a holder member that can be rotated about a shaft 50*a*. According to the rotational movement of the holder member, the four developing devices 51, 52, 53, 54 are selectively faced with the photosensitive member 20 while keeping the relative positional relationship therebetween. As for the specific construction of the respective developing device, description will be made later.

The primary transfer unit 60 is an apparatus for transferring a monochromic toner image created on the photosensitive member 20 to the intermediate transfer member 70.

The intermediate transfer member 70 is an endless belt that can be rotatingly driven substantially at the same peripheral speed as the photosensitive member 20. Carried on the intermediate transfer member 70 is a toner image of at least one color selected from black, magenta, cyan and yellow. At the time of forming a full color image, for instance, the full color image is created by way of sequentially transferring the toner images of black, magenta, cyan and yellow one atop the other.

The secondary transfer unit 80 is an apparatus that serves to transfer the monochromic, full color image or other toner image formed on the intermediate transfer member 70 to the recording medium P such as papers, films and fabrics.

The fixing unit 90 is an apparatus for affixing the toner image on the recording medium P as a permanent image by way of heating and pressing the recording medium P to which the toner image has been transferred.

The cleaning unit 75 is an apparatus that comprises a rubber-made cleaning blade 76 abutting to the surface of the photosensitive member 20 at a position between the primary transfer unit 60 and the electrifying unit 30. The cleaning unit 75 is adapted to, by use of the cleaning blade 76, scrape and remove the residual toner left on the photosensitive member 20 after the toner image has been transferred to the intermediate transfer member 70 by means of the primary transfer unit 60.

Operation of the printer 10 with the afore-mentioned construction will now be described in detail.

At first, in response to the command from a host computer not shown in the drawings, the photosensitive member 20, the developing roller 510(see FIG. 3) mounted to the developing unit 50, and the intermediate transfer member 70 begin to rotate. The photosensitive member 20 is sequentially electrified by means of the electrifying unit 30 as it is subject to rotation. The electrified region of the photosensitive member 20 arrives at an exposure position along with the rotation of the photosensitive member 20, at which position the exposure unit 40 causes a latent image to be created on the electrified region based on the image information regarding the first color, e.g., yellow Y.

The latent image formed on the photosensitive member 20 comes to a developing position in accordance with the rotation of the photosensitive member 20 and is developed with yellow toner by the yellow developing device 54. This assures that a yellow toner image is formed on the photosensitive member 20. At this time, the yellow developing device 54 of the YMCK developing unit 50 is faced with the photosensitive member 20 at the developing position.

The yellow toner image formed on the photosensitive member 20 comes to a primary transfer position in accordance with the further rotation of the photosensitive member 20 and is transferred to the intermediate transfer member 70 by means of the primary transfer unit 60. At this moment, applied to the primary transfer unit 60 is a primary transfer voltage (primary transfer bias) whose polarity is opposite to the electrifying polarity of the toner. Furthermore, during this period of time, the secondary transfer unit 80 remains spaced apart from the intermediate transfer member 70.

The same treatment as set forth just above is repeatedly carried out for the second, third and fourth colors so that the toner images for each of the colors corresponding to the respective image signal can be transferred to the intermediate transfer member 70 one above the other. This assures that a full color image is formed on the intermediate transfer member 70.

In the meantime, the recording medium P is conveyed from the paper supply tray 92 to the secondary transfer unit 80 by means of a paper supply roller 94 and a register roller 96.

The full color toner image formed on the intermediate transfer member 70 comes to a secondary transfer position in accordance with the rotation of the intermediate transfer member 70 and is transferred to the recording medium P by means of the secondary transfer unit 80. At this time, the secondary transfer unit 80 is pressed against the intermediate transfer member 70, with a secondary transfer voltage (secondary transfer bias) being applied to the secondary transfer unit 80.

The full color toner image thus transferred to the recording medium P is heated and pressed by the fixing unit 90 so that it can be meltingly affixed to the recording medium P.

Meanwhile, after the photosensitive member 20 has passed the primary transfer position, the toner sticking to the surface of the photosensitive member 20 is scraped off by the cleaning blade 76 of the cleaning unit 75 in preparation for the subsequent electrifying process for forming the next latent image. The toner scraped off in this manner is collected into a residual toner recovery part of the cleaning unit 75.

[Developing Device]

Figure 2:
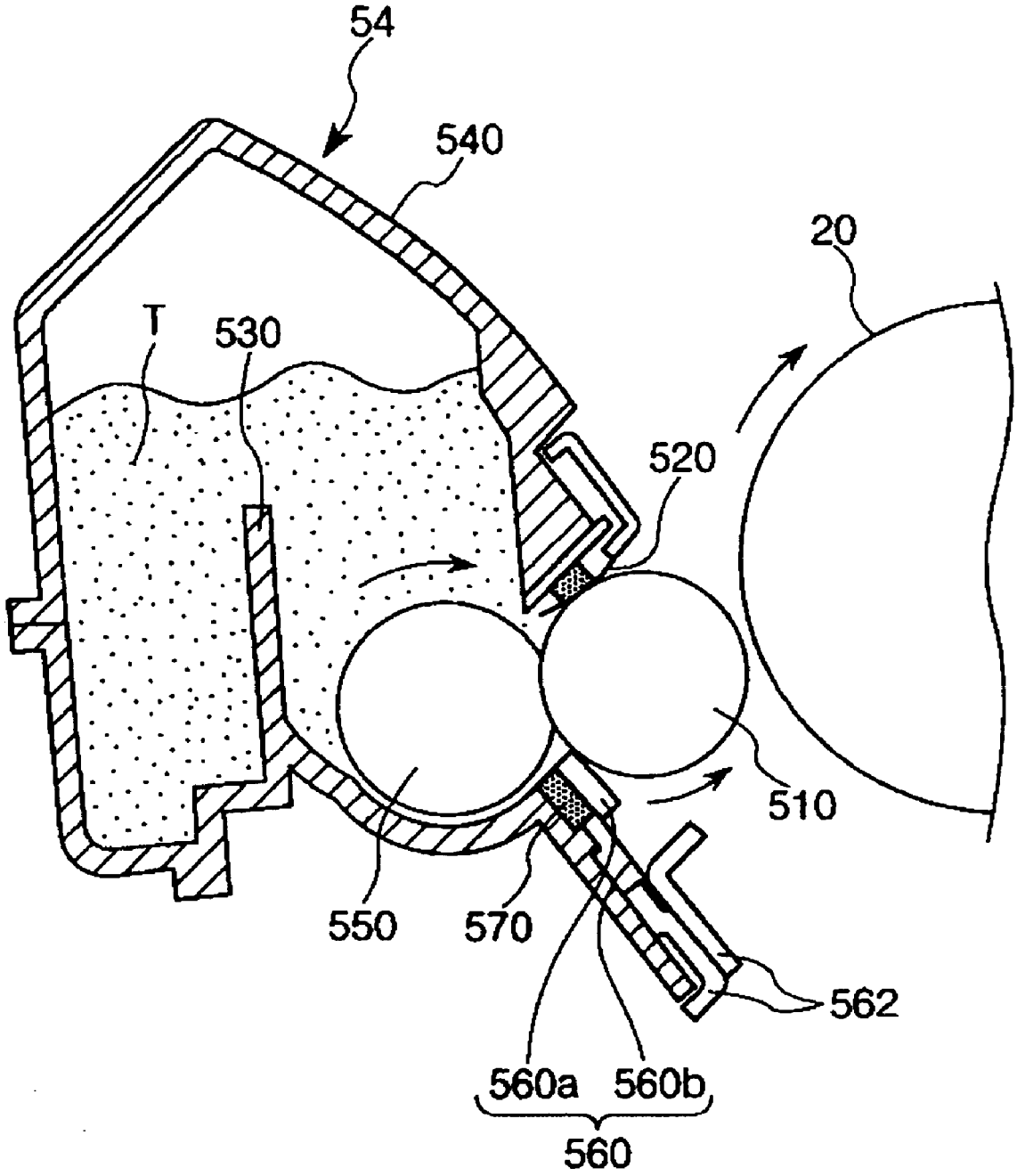
FIG. 2 is a schematic view illustrating the simplified construction of a developing device employed in the image forming apparatus shown in FIG. 1.

Referring next to FIG. 2, the yellow developing device 54 of the YMCK developing unit 50 will be described in detail.

FIG. 2 is a schematic cross-sectional view illustrating the simplified construction of the yellow developing device 54. No description is offered regarding the black developing device 51, the magenta developing device 52 and the cyan developing device 53 because they have the same construction as that of the yellow developing device 54 although the toner used differs from each other.

The yellow developing device 54 comprises a housing 540 for receiving the toner T of yellow color, a developing roller 510 as a toner carrier, a toner supply roller 550 for feeding the toner T to the developing roller 51 and a restricting blade 560 for restricting the layer thickness of the toner T carried by the developing roller 510.

The housing 540 is adapted to store the toner T within a receiving part 530 formed as the internal space thereof. On and in the vicinity of the opening of the housing 540, which is provided at the bottom of the receiving part 530, the toner supply roller 550 and the developing roller 510 are rotatably supported in a mutually compressing contact relationship. In addition, the toner supply roller 550 and the restricting blade 560 are mounted to the housing 540 so that they can make compressing contact with the developing roller 510. Moreover, a seal member 520 is mounted to the housing 540 to prevent any toner leakage from the space between the housing 540 and the developing roller 510 at the opening of the housing 540.

The developing roller 510 serves to carry and transport the toner T into a developing position where the toner T is faced with the photosensitive member 20. The developing roller 510 is composed of aluminum, stainless steel and iron, etc., as major components thereof. If needed, the surface of the developing roller 510 is either plated with nickel, chromium and other metal or subjected to sandblasting.

Furthermore, the developing roller 510 is rotatable about its axis and, in this embodiment, rotates in a direction opposite to the rotational direction of the photosensitive member 20. In other words, at the region in which the developing roller 510 and the photosensitive member 20 are faced with each other, the circumferential surfaces of the developing roller 510 and the photosensitive member 20 are caused to travel in the same direction.

Still further, according to this embodiment, when the yellow developing device 54 performs its developing operation, the developing roller 510 and the photosensitive member 20 are faced with each other in a non-contact condition, with a minute gap left therebetween. And, by way of applying alternate electric field to between the developing roller 510 and the photosensitive member 20, the toner T is caused to fly from the developing roller 510 up to the photosensitive member 20, thus performing the developing process.

The toner supply roller 550 serves to feed the toner T stored in the receiving part 530 to the developing roller 510. This toner supply roller 550 is made from polyurethane foam and the like, and makes compressing contact with the developing roller 510 in an elastically deformed condition. According to the present embodiment, the toner supply roller 550 rotates in a direction opposite to the rotational direction of the developing roller 510. Furthermore, the toner supply roller 550 has not only the function of feeding the toner T stored in the receiving part 530 to the developing roller 510 but also a function of removing the residual toner T that may be left on the developing roller 510 at the end of the developing process.

The restricting blade 560 is adapted to delimit the layer thickness of the toner T carried by the developing roller 510 and, at the same time, performs frictional electrification to apply electric charges to the toner T carried by the developing roller 510. The restricting blade 560 also plays the role of a seal member at the upstream side of the developing position in the rotational direction of the developing roller 510. The restricting blade 560 is provided with a rubber part 560*a* functioning as an abutting member that makes abutment to the developing roller 510 along the axis thereof and a rubber support part 560*b* functioning as a support member that supports the rubber part 560*a*. The rubber part 560*a* comprises silicon rubber, urethane rubber and the like as its major material. In view of the fact that the rubber support part 560*b* has a function of urging the rubber part 560*a* toward the developing roller 510, a thin plate of sheet shape with resiliency made of, e.g., phosphor bronze and stainless steel is used to produce the rubber support part 560*b*. This rubber support part 560*b* is secured at its end to a blade-supporting sheet metal 562, which in turn attached to the housing 540. Under the state that the seal member 520 is attached to the housing 540, with the developing roller 510 being mounted in place, the rubber part 560*a* is pressed against the developing roller 510 by the resilient force that will be induced by the flexural deformation of the rubber support part 560*b*.

Furthermore, in accordance with the present embodiment, a blade-backing member 570 is provided at the opposite side of the restricting blade from the developing roller 510. This blade-backing member 570 serves to prevent the toner T from infiltrating between the rubber support part 560*b* and the housing 540 and, at the same time, plays a role of pressing the rubber part 560*a* into contact with the developing roller 510.

In this embodiment, the free end portion of the restricting blade 560, i.e., the opposite end portion of the restricting blade 560 from the side supported by the blade-supporting sheet metal 562 is not brought into contact with the developing roller 510 at the terminal edge thereof but makes contact with the developing roller 510 at the region somewhat spaced apart from the terminal edge. In addition, the restricting blade 560 is disposed such that the frontal end thereof can face the upstream side of the rotational direction of the developing roller 510 in what is called counter-abutment manner.

With the yellow developing device 54 constructed as set forth above, the toner supply roller 550 is adapted to feed the toner T contained in the receiving part 530 to the developing roller 510. In concert with the rotation of the developing roller 510, the toner T thus supplied to the developing roller 510 comes to an abutment position where the restricting blade 560 makes abutment to the developing roller 510. As the toner T travels through the abutment position, the thickness of the toner layer is delimited by the restricting blade 560 and electric charges are applied to the toner T. After the toner layer is delimited in thickness, further rotation of the developing roller 510 brings the toner T carried on the developing roller 510 into a developing station where the toner T is faced with the photosensitive member 20, at which position the latent image on the photosensitive member 20 is developed by alternate electric fields. As the developing roller 510 continues to rotate, the toner T on the developing roller 510 leaves the developing position and then moves past the seal member 520, at which time the toner T is collected in the housing 540 without being scraped off by the seal member 520.

In the developing process as described above, in order to assure good developing treatment, a need exists to make the quantity of the toner T on the developing roller 510 uniform over the substantially entire region in the axial direction of the developing roller 510. For this reason, according to the present embodiment, the quantity of the toner on the developing roller of a single developing device is measured by use of the below-mentioned measuring device to examine the developing device at the final stage in the developing device manufacturing line. This is done before the developing device is fabricated into the image forming apparatus. Major causes that make the quantity of the toner T on the developing roller 510 uneven over the substantially entire region in the axial direction of the developing roller 510, which leads to poor quality of the developing device, include irregularity of the surface of the developing roller, incomplete contact of the restricting blade with the developing roller and failure for the restricting blade to electrify the toner, for instance. Such defects in quality can be examined by means of the measuring device described below.

[Toner Quantity Measuring Device of First Embodiment]

Figure 3:
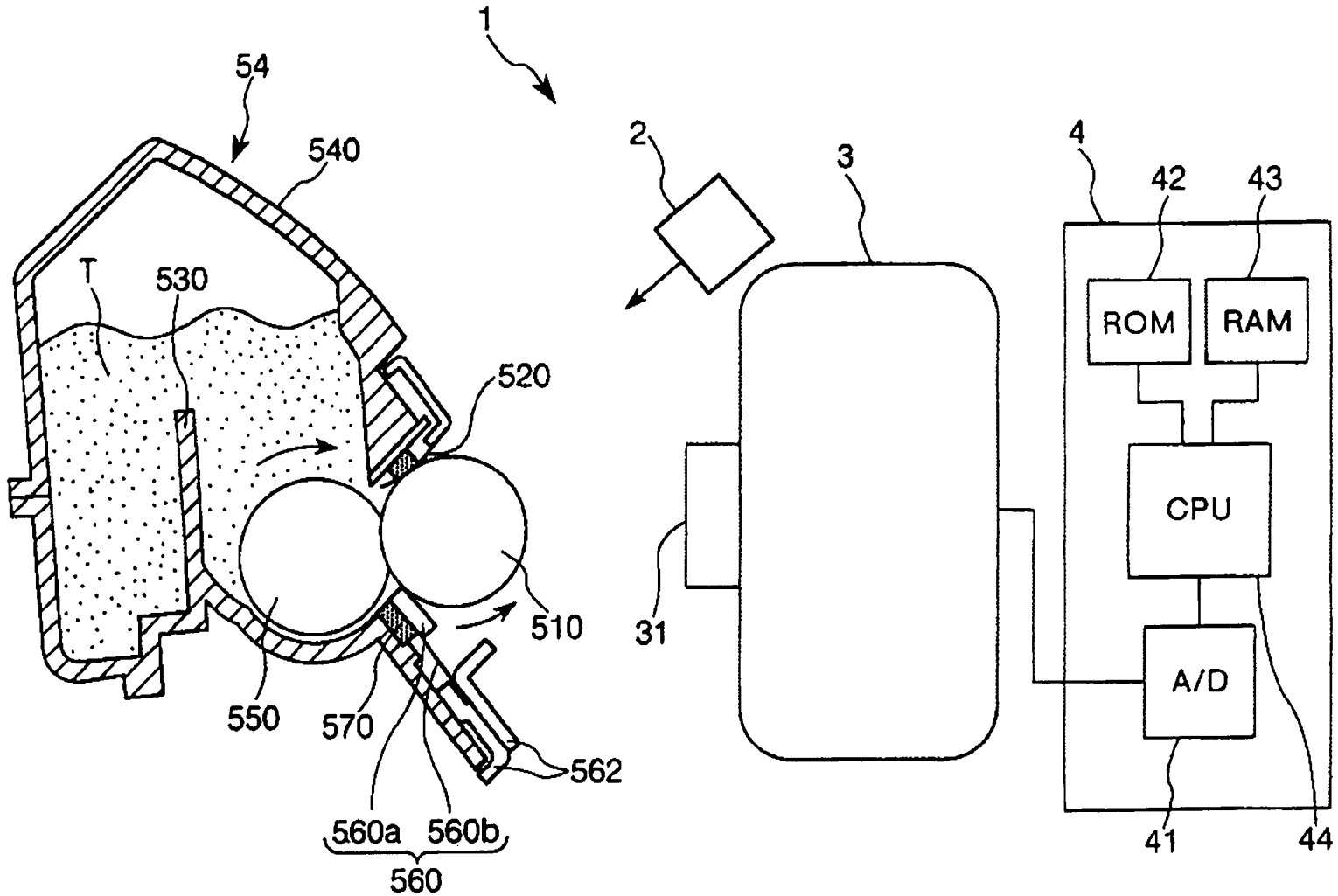
FIG. 3 is a schematic view illustrating the simplified construction of a toner quantity measuring device according to a first embodiment of the present invention.

With reference to FIG. 3, a toner quantity measuring device 1 according to the first embodiment will be described herein below. The following description will be made by taking an instance that the toner quantity measuring device 1 is used to measure the quantity of the toner on the developing roller 510 of the yellow developing device 54.

FIG. 3 is a schematic view illustrating the simplified construction of the toner quantity measuring device 1 in accordance with the first embodiment.

As shown in FIG. 3, the measuring device 1 comprises a light source 2 for irradiating light on the developing roller 510 that serves as a toner carrier adapted to carry the toner T in the form of a thin layer, a chromaticity detecting device 3 for detecting average chromaticity of the light reflected from the developing roller 510 and a calculating device 4 for calculating the toner quantity based on the chromaticity detected by the chromaticity detecting device 3.

The light source 2 is adapted to irradiate the light with such a wavelength zone that allows the chromaticity detecting device 3 to detect the average chromaticity of the toner on the developing roller 510.

According to the first embodiment, a xenon lamp that generates white color light is employed as the light source 2. This assures that the average chromaticity of the light reflected from the developing roller 510 can be detected in more accurate manner, making it possible to precisely measure the toner quantity. The white color light source is not particularly limited to the xenon lamp but may include a mercury lamp, a white color laser and the like.

Moreover, other light sources than the white color light source may be used as the light source 2 as far as they can irradiate the light having such a wavelength zone that allows the chromaticity detecting device 3 to detect the average chromaticity of the toner on the developing roller 510.

Once the light is irradiated from the light source 2 onto the developing roller 510, the wavelength component whose chromaticity corresponds to the quantity of the toner on the developing roller 510(especially the amount of coloring agent) is reflected from the developing roller 510. The chromaticity of the light reflected from the developing roller 510 is detected by the chromaticity detecting device 3 described below.

The chromaticity detecting device 3 is adapted to detect the average chromaticity of the light reflected from the developing roller 510.

According to the first embodiment, a XYZ line camera is employed as the chromaticity detecting device 3. The XYZ line camera has three charge coupled devices(CCD) corresponding to three coordinate values and is adapted to detect the chromaticity as the three coordinate values(X, Y, Z) by way of operationally treating the output signals of the charge coupled devices.

Use of the chromaticity detecting device 3, which is provided with the charge coupled devices and capable of detecting the chromaticity through the operational treatment of the output signals from the charge coupled devices, makes sure that the average chromaticity of the light reflected from the developing roller 510 can be detected in more accurate manner, thus making it possible to precisely measure the toner quantity. In addition, it becomes possible to accurately detect the average chromaticity of the light reflected from the developing roller 510, even when the amount of the light irradiated from the light source 2 is relatively small. This permits use of a small-sized and cost-effective light source.

Furthermore, use of the chromaticity detecting device 3 adapted to detect the chromaticity as the three coordinate values allows the calculating device 4 described later to calculate the toner quantity in a relatively simple method, based on the average color difference.

It should be appreciated that the chromaticity detecting device 3 is not particularly limited to the tristimulus value type charge coupled devices noted above but may include any type of chromaticity detecting device, as far as it can detect the average chromaticity of the light reflected from the developing roller 510. In addition to the tristimulus value type charge coupled devices, for example, a spectroscopic charge coupled device, a solid-state image sensing device such as a complementary metal oxide semiconductor(C-MOS), an image pickup tube and the like may be used as the chromaticity detecting device 3.

The calculator device 4 is adapted to derive the difference between the average chromaticity detected by the chromaticity detecting device 3(referred to as "detected chromaticity" herein below) and a predetermined chromaticity and then calculate the toner quantity in correspondence to the difference thus derived.

According to the first embodiment, the calculating means 4 is provided with an AD converter circuit 41, a ROM 42, a RAM 43 and a CPU 44, as illustrated in FIG. 3.

The AD converter circuit 41 is adapted to convert the analog output values of the chromaticity detecting device 3 to digital ones.

The ROM 42 is adapted to store a program for calculating either the difference between the detected chromaticity and the predetermined chromaticity or the quantity of the toner, a predetermined chromaticity, a conversion table for converting the afore-mentioned difference to the toner quantity, and so on. The predetermined chromaticity or the conversion table is stored in multiple number and properly selected depending on the kind of toner to be measured, e.g., the kind of coloring agent in the toner.

The RAM 43 is adapted to perform the function of storing the values derived by the program.

The CPU 44 is adapted to derive the difference value between the detected chromaticity digitized by the AD converter circuit 41 and the predetermined chromaticity stored in the ROM 42, in accordance with the program stored in the ROM 42, and then convert the difference value to the toner quantity based on the conversion table. According to the first embodiment, although the predetermined chromaticity is fixedly stored in the ROM 42 beforehand, it would be possible to use, as the predetermined chromaticity, the chromaticity obtained by monitoring the light irradiated from the light source 2 onto the developing roller 510.

As described earlier, once the light is irradiated from the light source 2 onto the developing roller 510, the wavelength component whose chromaticity corresponds to the quantity of the toner on the developing roller 510 is reflected from the developing roller 510 and subsequently detected by the chromaticity detecting device 3. This means that the difference between the detected chromaticity and the predetermined chromaticity corresponds to the quantity of the toner on the developing roller 510. The calculating device 4 can calculate the toner quantity by taking advantage of the correlation between the detected chromaticity and the toner quantity.

The toner quantity thus calculated can be visually displayed in the form of numerical values and the like by use of such a display means as liquid crystal displays (not shown), which is connected to the calculating device 4. This allows the operator to make decision as to whether the result measured falls inside the predetermined reference range. It is also possible to show, on the display means, the difference between the calculated toner quantity and the predetermined reference value and whether the toner quantity calculated falls inside the predetermined reference range.

In the measuring process described above, it is preferred that the chromaticity detecting device 3 detects the average chromaticity while scanning the range of measurement along the rotational axis direction of the developing roller 510. This makes sure that the toner quantity distribution in the rotational axis direction of the developing roller 510 can be measured with a relatively simple arrangement.

As described above, the calculating device 4 can calculate the quantity of the toner T in correspondence to the difference between the average chromaticity detected by the chromaticity detecting device 3 and the predetermined chromaticity. This makes it possible to precisely measure the quantity of the toner T on the developing roller 510 within a shortened period of time and without making contact with the developing roller 510. Furthermore, the measurement can be performed in an environmentally friendly manner, because no waste is generated during the measuring process.

Although the developing roller 510 has been described as an example of the toner carrier in the foregoing embodiment, it should be appreciated that the toner carrier is not particularly limited to the developing roller 510 but may include other types of toner carriers that have an ability to carry the toner. For example, the photosensitive member 20 or the intermediate transfer member 70 of the afore-mentioned image forming apparatus may be employed as the toner carrier to thereby measure the quantity of the toner carried on the surface thereof. It would be also possible to use the recording medium P as the toner carrier and measure the quantity of the toner carried on the surface thereof.

Moreover, although the foregoing description on the first embodiment has been offered in relation to the instance that the quantity of the toner on the toner carrier is measured to examine the product quality in a manufacturing line, it would be equally possible to incorporate the toner quantity measuring device into the image forming apparatus and then carry out a variety of operation control for the image forming apparatus, based on the measuring result obtained by the toner quantity measuring device.

Hereinbelow, a printer 10 that incorporates the toner quantity measuring device 1 will now be described briefly, as an example of the operation control for the image forming apparatus that employs the toner quantity measuring device according to the present invention.

If the quantity of the toner carried on the developing roller 510 or the photosensitive member 20 is measured with the toner quantity measuring device 1 according to the first embodiment, it becomes possible, for instance, to control the developing bias in accordance with the toner quantity measured. In this instance, by way of reducing the developing bias in proportion to the increase of the toner quantity measured for example, it is possible to make uniform the amount of the toner that flies from the developing roller 510 up to the photosensitive member 20. In addition, the quantity of the toner on the photosensitive member 20 can be measured in a relatively simple and accurate manner by virtue of, for example, creating a latent image on the no-passage-of-paper area of the photosensitive member 20, converting the latent image to a toner image and measuring the quantity of the toner over the toner image. Particularly, due to the fact that the present invention measures the toner quantity on the basis of the chromaticity corresponding to the amount of the coloring agent in the toner, it is possible to accurately control the amount of the coloring agent on the developing roller 510 or the photosensitive member 20 even if there exist variation in the amount of the coloring agents that are present between the toner particles. As a result, the color image forming apparatus constructed in this manner can generate images with excellent color reproducibility in compliance with the input information on the image and the like.

Further, in case that the quantity of the toner on the intermediate transfer member 70 is measured with the toner quantity measuring device 1 according to the first embodiment, it is possible, for example, to control the primary transfer bias or the secondary transfer bias in correspondence to the toner quantity measured. In this event, by virtue of reducing the primary transfer bias or the secondary transfer bias in proportion to the increase of the toner quantity measured for example, it becomes possible to enhance the transferability of the toner from the photosensitive member 20 to the intermediate transfer member 70 or the transferability of the toner from the intermediate transfer member 70 to the recording medium P. Further, in this instance, the quantity of the toner can be measured in a relatively simple and accurate manner by way of, for example, creating a latent image on the no-passage-of-paper area of the photosensitive member 20, converting the latent image to a toner image and measuring the quantity of the toner transferred to the intermediate transfer member 70.

Moreover, the toner fixing conditions in the fixing unit 90 can be controlled based on the quantity of the toner that has been measured with respect to at least one of the developing roller 510, the photosensitive member 20, the intermediate transfer member 70 and the recording medium P. In other words, it is possible to enhance the toner fixing result by virtue of, in response to the increase of the toner quantity measured, elevating the heating temperature of a fixing roller built in the fixing unit 90, causing the fixing roller and the pressure roller to make contact with a greater pressing force or slowing down the transportation speed of the recording medium P, for instance.

EXAMPLES

Examples for the first embodiment will be described below.

The toner quantity measuring device of the type shown in FIG. 3 was used to measure the toner quantity corresponding to the amount of the light reflected from the developing roller of each of the yellow, magenta, cyan and black developing devices whose construction is illustrated in FIG. 3. At this event, a xenon lamp was employed as the light source and a XYZ line camera (XL-S made by Kurabo Industries Ltd.), i.e., tristimulus value type charge coupled devices, was used as the chromaticity detecting device.

Toners for each of the colors were prepared by kneading and grinding polyester and coloring agent, as major components thereof, so that they can have an average particle size of 8.5 μm. Non-benzine based pigment was used as the coloring agent for the yellow toner, carmine based pigment for the magenta toner, copper phthalocyanine pigment for the cyan toner and carbon black for the black toner. Furthermore, these toners make use of silica and titania as external additives.

Measurement of the toner quantity, etc. of the yellow, magenta, cyan and black developing devices was performed for two kinds of developing devices (device 1 and device 2) whose rollers carry different quantity of toner.

Table 1 shows the result of measuring the quantity of the toner carried on the developing rollers of the respective developing devices. Also shown in Table 1 are L, a and b values (Hunter-Lab system) corresponding to the output values (tristimulus values (three coordinate values) X, Y, Z) of the XYZ line camera and the color difference between these values and the predetermined chromaticity.

In the Reference Examples, an adhesive tape (made by Sumitomo 3M Corporation) of known weight with the width of 12 mm and the length of 275 mm was used to carefully measure the quantity of the toner on the developing rollers of the respective developing device, after the measuring process was completed with respect to the Examples according to the invention. The measurement was made at the same area as in each of the Examples for the present invention. The result measured in the Reference Examples is also indicated in Table 1.

TABLE 1

| Developing | | Examples (Present Invention) | | | | | | | | Reference Examples (Adhesive Tape) |
|---|---|---|---|---|---|---|---|---|---|---|
| | | Toner Quantity | Chromaticity Detected | | | Color Difference (Detected-Predetermined) | | | | Toner Quantity |
| Devices | | Measured | L | A | b | ΔL | Δa | Δb | ΔE | Measured |
| Y* | Device 1 | 0.59 | 76.57 | −15.40 | 78.50 | 0.00 | 0.00 | 0.00 | 0.00 | 0.59 |
| | Device 2 | 0.75 | 76.78 | −15.35 | 78.95 | 0.21 | 0.06 | 0.45 | 0.50 | 0.75 |
| M* | Device 1 | 0.62 | 40.69 | 49.29 | 3.85 | 0.00 | 0.00 | 0.00 | 0.00 | 0.62 |
| | Device 2 | 0.70 | 40.66 | 49.33 | 4.00 | −0.03 | 0.04 | 0.15 | 0.16 | 0.70 |
| C* | Device 1 | 0.59 | 38.92 | −9.90 | −46.67 | 0.00 | 0.00 | 0.00 | 0.00 | 0.59 |
| | Device 2 | 0.71 | 38.38 | −8.93 | −47.20 | −0.54 | 0.98 | −0.53 | 1.24 | 0.71 |
| B* | Device 1 | 0.59 | −65.74 | 5.64 | −13.26 | 0.00 | 0.00 | 0.00 | 0.00 | 0.59 |
| | Device 2 | 0.68 | −66.05 | 5.58 | −12.99 | −0.30 | −0.06 | 0.27 | 0.41 | 0.68 |

*Y: yellow, M: magenta, C: cyan and B: black

Referring to Table 1, it will be appreciated that the chromaticity in the Examples of the present invention corresponds to the toner quantity measured in the Reference Examples. According to the Examples of the present invention, the same result of measurement as in the case of using the adhesive tape for careful measurement of the toner quantity was obtained by using a conversion table that defines the correlation between the color difference and the toner quantity. In this manner, the quantity of the toner on the developing roller can be measured extremely precisely through the use of the toner quantity measuring device according to the first embodiment. Furthermore, the toner quantity measuring device of the first embodiment creates no scratch on the developing roller because it is adapted to measure the toner quantity without making contact with the developing roller. The measuring time required in the present toner quantity measuring device is also sharply shortened, as compared to the method in which the adhesive tape is used.

In addition to the above, the quantity of the toner carried on the photosensitive member, the intermediate transfer member and the recording medium was also measured in the same fashion as in the Examples noted above, the result of which was as good as the measuring result obtained in the foregoing Examples.

[Toner Quantity Measuring Device of Second Embodiment]

Figure 4:
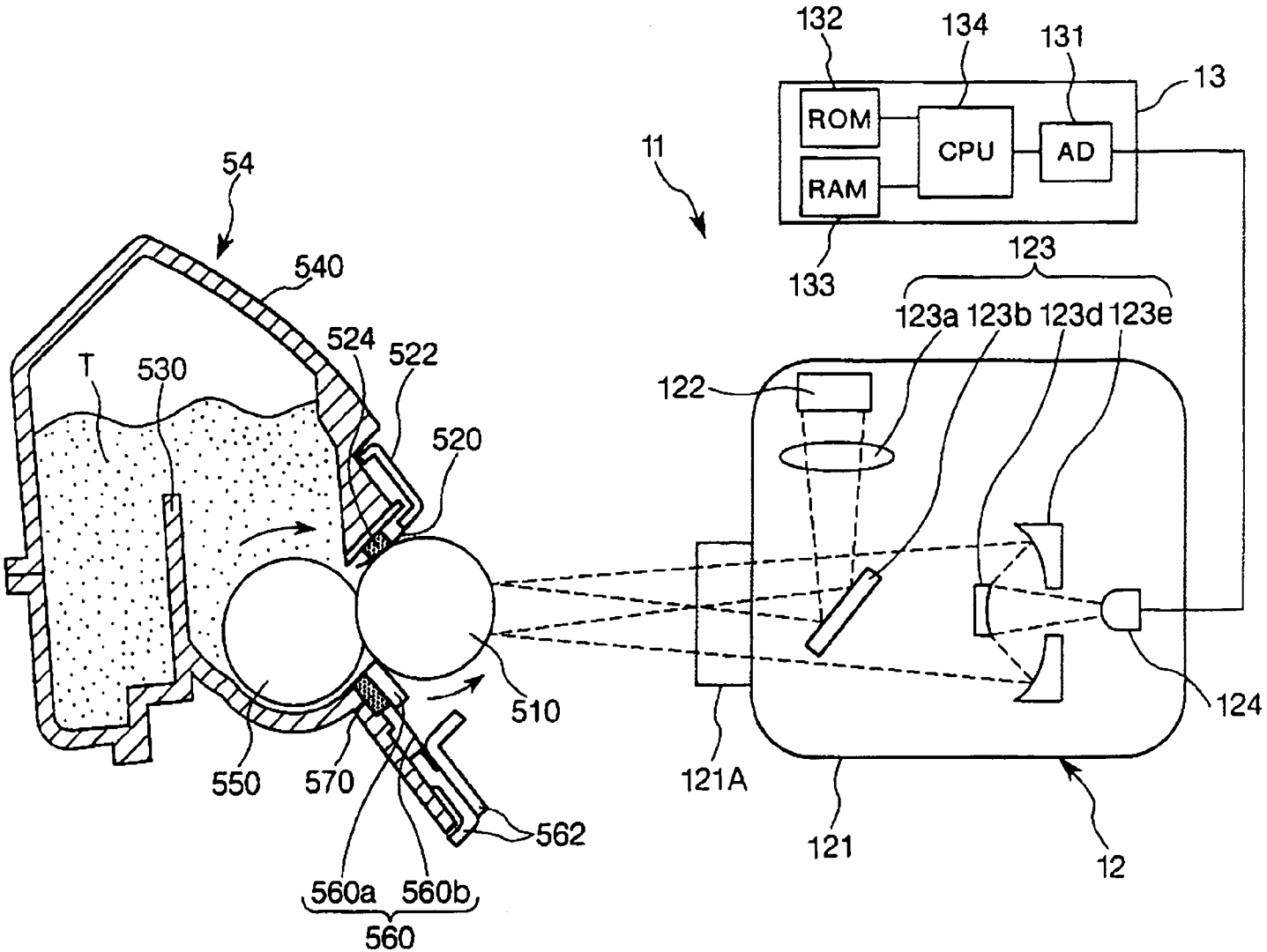
FIG. 4 is a schematic view illustrating the simplified construction of a toner quantity measuring device according to a second embodiment of the present invention

With reference to FIG. 4, a toner quantity measuring device 11 according to the second embodiment will be described below. It should be noted that operation and construction of the image forming apparatus are identical with those of the first embodiment. The following description will be made by taking an instance that the toner quantity measuring device 11 is used to measure the quantity of the toner on the developing device 510 of the yellow developing device 54.

FIG. 4 is a schematic view illustrating the simplified construction of the toner quantity measuring device 11 in accordance with the second embodiment.

As shown in FIG. 4, the measuring device 11 comprises a detecting device 12 for irradiating infrared rays on the developing roller 510 that serves as a toner carrier adapted to carry the toner T in the form of a thin layer and for detecting the intensity of the infrared rays reflected from the developing roller 510, and a calculating device 13 for calculating the toner quantity based on the difference between the intensity detected by the detecting device 12 and a predetermined intensity.

Referring to FIG. 4, the detecting device 12 is provided with a case 121, a light source 122 for emitting infrared rays, an optical system 123 and a light receiving element 124 for receiving the infrared rays reflected from the developing roller 510.

The case 121 is adapted to receive the light source 122, the optical system 123 and the light receiving element 124 that functions as an intensity detecting means. In a part of the case 121, there is provided a window 121A that permits the infrared rays to pass therethrough.

The light source 122 is of the type capable of emitting the infrared rays with such a wavelength component that can be absorbed by the resin, a component of the toner.

The optical system 123 is adapted to collect the infrared rays emitted from the light source 122 with a lens 123*a* and then direct the infrared rays toward the developing roller 510 with a planar mirror 123*b*. It is another role of the optical system 123 to collect the infrared rays reflected from the developing roller 510 with a group of concave mirrors 123*e* and subsequently direct the infrared rays toward the light receiving element 124 with a planar mirror 123*d*.

According to the second embodiment, the light source 122, the lens 123*a* and the planar mirror 123*b* cooperate to form a infrared ray irradiating means that serves to irradiate the infrared rays onto the developing roller 510. The infrared rays reflected from the planar mirror 123*b* are irradiated onto the developing roller 510 through the window 121A of the case 121, in the second embodiment. No need exists for the lens 123*a* and the planar mirror 123*b* in case that the infrared rays are directly irradiated onto a desired area of the developing roller 510 by the light source 122.

It should be noted that the infrared ray irradiating means is not particularly limited to the one mentioned above but may include any type of infrared ray irradiating means, for example, a gas mantle, a glow-bar lamp, a Nernst lamp, a tungsten bulb, a platinum ribbon heated by electric current, a quartz mercury lamp, and such lasers as a gas laser, a solid-state laser, a color laser and a semiconductor laser, as far as they can emit the infrared rays with such a wavelength component that can be absorbed by the resin contained in the toner.

Of these, it is preferred to use such an infrared ray irradiating means that can irradiate, on the developing roller 510, the infrared rays whose wavelength corresponds to the absorption spectrum, e.g., 2,960 $cm^{-1}$, of C—H bonds of the resin contained in the toner T. With such an arrangement, the quantity of the toner T on the developing roller 510 can be calculated by way of detecting the amount of C—H bonds, a characterizing structure of the resin contained in the toner T. This assures trustworthy and accurate measurement of the toner quantity.

Furthermore, it is preferred that the infrared rays irradiated from the infrared ray irradiating means onto the developing roller 510 contain a wavelength component absorbable by the resin contained in the toner. In addition to the wavelength component corresponding to the absorption spectrum of C—H bonds, the infrared rays may contain a wavelength component that corresponds to the absorption spectrum of other bonds such as C═O bonds and the like.

Still further, the infrared rays may contain either a single one of these wavelength components or other wavelength components. In case of the infrared rays with a single wavelength component being intended to be used, for example, the infrared ray irradiating means can be provided by way of causing the light emitted from a light source with plural wavelength components or broadband wavelength components to pass through a known filter that allows passage of the infrared rays of specific wavelength. It is also possible to use an infrared ray laser of single wavelength as the infrared ray irradiating means.

By virtue of this, a part of the infrared rays irradiated onto the developing roller 510 from the infrared ray irradiating means is absorbed to the toner on the developing roller 510 in an amount corresponding to the quantity of the toner, whereas the remaining part of the infrared rays is reflected from the developing roller 510 so that the intensity of the reflected infrared rays(the remaining part) can be detected by the light receiving element 124 described below.

According to the second embodiment, as illustrated in FIG. 4, the infrared rays reflected from the developing roller 510 (the remaining part) is collected by the group of concave mirrors 123*e* and then reflected from the planar mirror 123*d*, after which the infrared rays is detected by the light receiving element 124. This prevents any reduction in the accuracy of detection offered by the light receiving element 124, even though the infrared rays are scattered by the concave and convex toner layer in the course of their reflection from the developing roller 510.

Moreover, the toner quantity measuring device 11 according to the second embodiment is so arranged that the infrared rays from the light source 122 can be irradiated onto the developing roller 510 in a direction substantially perpendicular to the surface of the developing roller 510. This plays a role in maintaining the quantity of the infrared rays scattered from the developing roller 510 to a relatively low level.

In accordance with the second embodiment, although the group of concave mirrors 123*e* constitutes the light collecting means for collecting the infrared rays reflected from the developing roller 510, the light collecting means is not particularly limited to the concave mirrors but may include other optical elements, e.g., a convex lens, as far as they can collect the infrared rays reflected from the developing roller 510.

The light receiving element 124 that constitutes the intensity detecting means comprises a thermistor capable of detecting the intensity of the infrared rays.

It should be appreciated that the intensity detecting means is not particularly limited to the thermistor but may include other suitable means, e.g., a photodiode, a phototransistor, a thermocouple, a bolometer, a semiconductor photoconductive element, a Gor-Rei detector, a radiometer, a photoelectric tube, a photoelectric cell and a photoconductive cell, as far as they can detect the infrared rays reflected from the developing roller 510.

In addition, it is preferred that the intensity detecting means is of the type capable of detecting the intensity of the infrared rays whose wavelength corresponds to the absorption spectrum of C—H bonds of the resin contained in the toner. This makes it possible that the quantity of the toner on the developing roller 510 is detected by way of detecting the amount of C—H bonds, a characterizing structure of the resin contained in the toner T, thereby assuring trustworthy and accurate measurement of the toner quantity.

The calculator device 13 is adapted to derive the difference between the intensity detected by the intensity detecting means (that is, the light receiving element 124) and a predetermined intensity and then calculate the toner quantity in correspondence to the difference thus derived.

According to the second embodiment, the calculating means 13 is provided with an AD converter circuit 131, a ROM 132, a RAM 133 and a CPU 134, as illustrated in FIG. 4.

The AD converter circuit 131 is adapted to convert the analog output values of the light receiving element 124 to digital ones.

The ROM 132 is adapted to store a program for calculating either the difference between the detected intensity and the predetermined intensity or the quantity of the toner, a predetermined intensity, a conversion table for converting the afore-mentioned difference to the toner quantity, and so on. The predetermined intensity or the conversion table is stored in multiple number and properly selected depending on the kind of toner to be measured, e.g., the kind of resin in the toner.

The RAM 133 is adapted to perform the function of storing the values derived by the program.

The CPU 134 is adapted to derive the difference value between the detected intensity digitized by the AD converter circuit 131 and the predetermined intensity stored in the ROM 132, in accordance with the program stored in the ROM 132, and then convert the difference value to the toner quantity based on the conversion table. According to the second embodiment, although the predetermined intensity is fixedly stored in the ROM 132 beforehand, it would be possible to use, as the predetermined intensity, the intensity obtained by monitoring the infrared rays irradiated from the light source 122 onto the developing roller 510.

As described earlier, once the infrared rays are irradiated from the infrared ray irradiating means onto the developing roller 510, a part of the infrared rays is absorbed to the toner T on the developing roller 510 in proportion to the amount of the toner and the remaining part of the infrared rays is reflected from the developing roller 510, after which the reflected part of the infrared rays is detected by the intensity detecting means 124. This means that the difference between the detected intensity and the predetermined intensity corresponds to the amount of the infrared rays absorbed by the toner on the developing roller 510. The calculating device 13 can calculate the toner quantity by taking advantage of the correlation between the amount of the infrared rays absorbed and the toner quantity.

The toner quantity thus calculated can be visually displayed in the form of numerical values and the like by use of such a display means as liquid crystal displays (not shown), which is connected to the calculating device 13. This allows the operator to make decision as to whether the result measured falls inside the predetermined reference range. It is also possible to show, on the display means, the difference between the calculated toner quantity and the predetermined reference value and whether the toner quantity calculated falls inside the predetermined reference range.

In the toner quantity measuring device described above, it is preferred that the developing roller 510 is composed of inorganic material at its surface region.

This ensures that the infrared rays irradiated onto the developing roller 510 is not absorbed to the developing roller 510 itself but to the toner on the developing roller 510 in an amount corresponding to the quantity of the toner, thus enabling the calculating device 13 to calculate the quantity of the toner on the developing roller 510 in a relatively simple manner.

Furthermore, it is preferred that the intensity detecting means 124 detects the intensity while scanning the range of detection in a rotational axis direction of the developing roller 510. By virtue of this, it becomes possible to measure, with the use of relatively simple arrangement, the toner quantity distribution in the direction of rotational axis of the developing roller 510.

As described above, the calculating device 13 can calculate the quantity of the toner T in correspondence to the difference between the intensity detected by the intensity detecting means 124 and the predetermined intensity. This makes it possible to precisely measure the quantity of the toner T on the developing roller 510 within a shortened period of time and without making contact with the developing roller 510. Furthermore, the measurement can be performed in an environmentally friendly manner, because no waste is generated during the measuring process.

Although the developing roller 510 has been described as an example of the toner carrier in the second embodiment, the toner carrier is not particularly limited to the developing roller 510 but may include other types of toner carriers that have an ability to carry the toner. For example, the photosensitive member 20 or the intermediate transfer member 70 of the afore-mentioned image forming apparatus may be employed as the toner carrier to thereby measure the quantity of the toner carried on the surface thereof. It would be also possible to use the recording medium P as the toner carrier and measure the quantity of the toner carried on the surface thereof.

Moreover, although the description on the second embodiment has been offered in relation to the instance that the quantity of the toner on the toner carrier is measured to examine the product quality in a manufacturing line, it would be also possible to incorporate the toner quantity measuring device into the image forming apparatus and then carry out a variety of operation control for the image forming apparatus based on the measuring result obtained by the toner quantity measuring device.

Hereinbelow, a printer 10 that incorporates the toner quantity measuring device 11 will now be described briefly, as an example of operation control for the image forming apparatus that employs the toner quantity measuring device according to the present invention.

If the quantity of the toner carried on the developing roller 510 or the photosensitive member 20 is measured with the toner quantity measuring device 11 according to the second embodiment, it becomes possible, for instance, to control the developing bias in accordance with the toner quantity measured. In this instance, by way of reducing the developing bias in proportion to the increase of the toner quantity measured for example, it is possible to make uniform the amount of the toner that flies from the developing roller 510 up to the photosensitive member 20. In addition, the quantity of the toner on the photosensitive member 20 can be measured in a relatively simple and accurate manner by virtue of, for example, creating a latent image on the no-passage-of-paper area of the photosensitive member 20, converting the latent image to a toner image and measuring the quantity of the toner over the toner image. In this case, it is preferred that the photosensitive member 20 is so constructed as not to sense the infrared rays from the light source 122.

Further, in case that the quantity of the toner on the intermediate transfer member 70 is measured with the toner quantity measuring device 11 according to the second embodiment, it is possible, for example, to control the primary transfer bias or the secondary transfer bias in accordance with the toner quantity measured. In this event, by virtue of reducing the primary transfer bias or the secondary transfer bias in proportion to the increase of the toner quantity measured for example, it becomes possible to enhance the transferability of the toner from the photosensitive member 20 to the intermediate transfer member 70 or the transferability of the toner from the intermediate transfer member 70 to the recording medium P. Further, in this instance, the quantity of the toner can be measured in a relatively simple and accurate manner by way of, for example, creating a latent image on the no-passage-of-paper area of the photosensitive member 20, converting the latent image to a toner image and measuring the quantity of the toner transferred to the intermediate transfer member 70.

Moreover, the toner fixing conditions in the fixing unit 90 can be controlled based on the quantity of the toner measured with respect to at least one of the developing roller 510, the photosensitive member 20, the intermediate transfer member 70 and the recording medium P. In other words, it is possible to enhance the toner fixing result by virtue of, in response to the increase of the toner quantity measured, elevating the heating temperature of a fixing roller built in the fixing unit 90, causing the fixing roller and the pressure roller to make contact with a greater pressing force or slowing down the transportation speed of the recording medium P, for instance. Although the amount of the resin contained in the toner has an effect on the fixing property of the toner, it does not matter in the second embodiment because the toner quantity measuring device 11 can accurately detect the amount of the resin contained in the toner. Accurate measurement of the resin amount makes sure that the toner is affixed to the recording medium P with a suitable temperature and pressure, even when there exists variation in the amount of the resin disposed between the toner particles.

According to the second embodiment, although description has been made for the instance that the toner quantity is detected based on the amount of the resin contained in the toner T on the developing roller 510, it would be equally possible to detect the toner quantity based on the amount of other components in the toner, e.g., pigments and additives.

In this event, the toner quantity can be measured by way of irradiating, on the toner carrier, the infrared rays whose wavelength corresponds to the inherent absorption spectrum of the pigments and the additives.

EXAMPLES

Examples for the second embodiment will be described below.

The toner quantity measuring device of the type shown in FIG. 4 was used to measure the toner quantity corresponding to the amount of the light reflected from the developing roller of each of the yellow, magenta, cyan and black developing devices whose construction is illustrated in FIG. 4. At this event, a tungsten lamp was employed as the light source and a photodiode was used as the light receiving element.

Toners for each of the colors were prepared by kneading and grinding polyester and coloring agent, as major components thereof, so that they can have an average particle size of 8.5 μm. Non-benzine based pigment was used as the coloring agent for the yellow toner, carmine based pigment for the magenta toner, copper phthalocyanine pigment for the cyan toner and carbon black for the black toner.

Measurement of the toner quantity in each of the yellow, magenta, cyan and black developing devices was performed for two kinds of developing devices (device 1 and device 2) whose rollers carry different quantity of toner.

Moreover, the measurement of the toner quantity was made 400 times for the total measuring time of 20 sec with 0.05 sec per measurement and the average of the toner quantity thus obtained was regarded as the toner quantity measured.

Table 2 shows the result of measuring the quantity of the toner carried on the developing rollers of the respective developing devices. Also shown in Table 2 is light absorbency, namely, the ratio of the amount of the infrared rays reflected from the developing roller versus the amount of the infrared rays emitted by the light source.

In the Reference Examples, a mending adhesive tape (made by Sumitomo 3M Corporation) of known weight with the width of 12 mm and the length of 275 mm was used to carefully measure the quantity of the toner on the developing rollers of the respective developing device, after the measuring process was completed with respect to the Examples according to the invention. The measurement was made at the same area as in each of the Examples for the present invention. The result measured in the Reference Examples is also indicated in Table 2.

TABLE 2

| | | Examples (Present Invention) | | Reference Examples (Adhesive Tape) |
|---|---|---|---|---|
| Developing Devices | | Toner Quantity Measured | Light Absorbency | Toner Quantity Measured |
| Yellow | Device 1 | 0.59 | 0.52 | 0.59 |
| | Device 2 | 0.75 | 0.54 | 0.75 |
| Magenta | Device 1 | 0.62 | 0.57 | 0.62 |
| | Device 2 | 0.70 | 0.58 | 0.70 |
| Cyan | Device 1 | 0.59 | 0.55 | 0.59 |
| | Device 2 | 0.71 | 0.59 | 0.71 |
| Black | Device 1 | 0.59 | 0.40 | 0.59 |
| | Device 2 | 0.68 | 0.41 | 0.68 |

As is apparent in Table 2, the light absorbency in the Examples of the present invention corresponds to the toner quantity measured in the Reference Examples. According to the Examples of the present invention, the same measuring result as in the case of using the adhesive tape for careful measurement of the toner quantity was obtained by using a conversion table that defines the correlation between the light absorbency and the toner quantity. In this manner, the quantity of the toner on the developing roller can be measured extremely precisely through the use of the toner quantity measuring device according to the second embodiment. Furthermore, the toner quantity measuring device of the second embodiment creates no scratch on the developing roller because it is adapted to measure the toner quantity without making contact with the developing roller. The measuring time required in the present toner quantity measuring device is also sharply shortened, as compared to the method in which the adhesive tape is used.

In addition to the above, the quantity of the toner carried on the photosensitive member, the intermediate transfer member and the recording medium was also measured in the same fashion as in the Examples noted above, the result of which was as good as the measuring result obtained in the foregoing Examples.

It should be noted that the subject application is based on Japanese Patent Application Nos. 2004-058225 and 2004-058226 filed on Mar. 2, 2004, the entire disclosure of which is incorporated herein by reference.

Although certain preferred embodiments of the present invention has been described for illustrative purposes, the invention is not limited to the particular embodiments disclosed herein. It will be apparent to those skilled in the art that various changes or modifications may be made thereto within the scope of the invention defined by the appended claims.

What is claimed is:

1. A toner quantity measuring device for use in measuring the quantity of toner containing coloring agent on a toner carrier which carries the toner in the form of a thin layer, comprising:

a light irradiator that irradiates light onto the toner carrier;

a chromaticity detector that detects average chromaticity of the light irradiated onto the toner carrier by the light irradiator and reflected from the toner carrier; and a calculator that calculates the toner quantity based on the average chromaticity detected by the chromaticity detector.

2. The toner quantity measuring device as recited in claim 1, wherein the calculator is adapted to calculate the toner quantity based on the color difference between the average chromaticity detected by the chromaticity detector and a predetermined chromaticity.

3. The toner quantity measuring device as recited in claim 1, wherein the chromaticity detector includes a charge coupled device for receiving the light reflected from the toner carrier and is adapted to detect the chromaticity by operationally treating output signals from the charge coupled device.

4. The toner quantity measuring device as recited in claim 1, wherein the chromaticity detector is adapted to detect the chromaticity as tristimulus values.

5. The toner quantity measuring device as recited in claim 1, wherein the light irradiator comprises a white color light source.

6. The toner quantity measuring device as recited in claim 1, wherein the toner carrier is rotatably provided, and the chromaticity detector is adapted to detect the average chromaticity while scanning a range of measurement in a direction along which a rotational axis of the toner carrier lies.

7. The toner quantity measuring device as recited in claim 1, wherein the toner carrier comprises a developing roller.

8. The toner quantity measuring device as recited in claim 1, wherein the toner carrier comprises a photosensitive member.

9. The toner quantity measuring device as recited in claim 1, wherein the toner carrier comprises a transfer member.

10. A toner quantity measuring device for use in measuring the quantity of toner on a toner carrier which carries the toner in the form of a thin layer, comprising:

an infrared ray irradiator that irradiates infrared rays onto the toner carrier;

an intensity detector that detects the intensity of the infrared rays reflected from the toner carrier; and a calculator that calculates the toner quantity based on the intensity detected by the intensity detector.

11. The toner quantity measuring device as recited in claim 10, wherein the calculator is adapted to calculate the toner quantity based on the difference between the intensity detected by the intensity detector and a predetermined intensity.

12. The toner quantity measuring device as recited in claim 10, wherein the toner comprises resin as a component thereof.

13. The toner quantity measuring device as recited in claim 10, wherein the toner comprises resin as a component thereof, and the intensity detector is adapted to detect the intensity of the infrared rays whose wavelength corresponds to absorption spectrum of C—H bonds of the resin contained in the toner.

14. The toner quantity measuring device as recited in claim 10, further comprising a light collector that collects the infrared rays reflected from the toner carrier, in which the intensity detector is adapted to detect the infrared rays collected by the light collector.

15. The toner quantity measuring device as recited in claim 10, wherein the infrared ray irradiator is adapted to irradiate, on the toner carrier, the infrared rays whose wavelength corresponds to absorption spectrum of C—H bonds of the resin contained in the toner.

16. The toner quantity measuring device as recited in claim 10, wherein the toner carrier is composed of inorganic material at its surface region.

17. The toner quantity measuring device as recited in claim 10, wherein the toner carrier is rotatably provided, and the intensity detector is adapted to detect the intensity while scanning a range of detection in a direction along which a rotational axis of the toner carrier lies.

18. The toner quantity measuring device as recited in claim 10, wherein the toner carrier comprises a developing roller.

19. The toner quantity measuring device as recited in claim 10, wherein the toner carrier comprises a photosensitive member.

20. The toner quantity measuring device as recited in claim 10, wherein the toner carrier comprises a transfer member.

21. A method of measuring toner quantity for measuring the quantity of toner containing coloring agent on a toner carrier that carries the toner in the form of a thin layer, comprising the steps of:

causing a light irradiator to irradiate light onto the toner carrier;

detecting average chromaticity of the light irradiated onto the toner carrier by the light irradiator and reflected from the toner carrier through the use of a chromaticity detector; and calculating the toner quantity based on the color difference between the average chromaticity detected by the chromaticity detector and a predetermined chromaticity.

22. A method of measuring toner quantity for measuring the quantity of toner on a toner carrier that carries the toner in the form of a thin layer, comprising the steps of:

causing an infrared ray irradiator to irradiate infrared rays on to the toner carrier;

detecting the intensity of the infrared rays reflected from the toner carrier through the use of an intensity detector; and calculating the toner quantity based on the intensity detected by the intensity detector.

23. An image forming apparatus for use in recording images formed through a series of image forming processes on a recording medium, comprising:

a toner quantity measuring device for measuring the quantity of toner containing coloring agent on a toner carrier which carries the toner in the form of a thin layer, wherein the toner quantity measuring device comprises a light irradiator that irradiates light onto the toner carrier, a chromaticity detector that detects average chromaticity of the light irradiated on to the toner carrier by the light irradiator and reflected form the toner carrier, and a calculator that calculates the toner quantity based on the average chromaticity detected by the chromaticity detector.

24. An image forming apparatus for use in recording images formed through a series of image forming processes on a recording medium, comprising:

a toner quantity measuring device for measuring the quantity of toner on a toner carrier which carries the toner in the form of a thin layer, wherein the toner quantity measuring device comprises an infrared ray irradiator that irradiates infrared rays onto the toner carrier, an intensity detector that detects the intensity of the infrared rays reflected from the toner carrier, and a calculator that calculates the toner quantity based on the intensity detected by the intensity detector.

* * * * *

UNITED STATES PATENT AND TRADEMARK OFFICE

CERTIFICATE OF CORRECTION

PATENT NO. : 7,292,797 B2
APPLICATION NO. : 11/070409
DATED : November 6, 2007
INVENTOR(S) : Masanao Kunugi and Mitsutaka Nishikawa It is certified that error appears in the above-identified patent and that said Letters Patent is hereby corrected as shown below:

FRONT PAGE, Page 2, Column 1, Line 18 "2002-031961" should be --2002-031981--

Signed and Sealed this

Twelfth Day of August, 2008

JON W. DUDAS
*Director of the United States Patent and Trademark Office*